US008059993B2

(12) United States Patent
Gayne et al.

(10) Patent No.: US 8,059,993 B2
(45) Date of Patent: Nov. 15, 2011

(54) ROTATING TONER CLEANING MEMBER FOR A TONER DELIVERY DEVICE IN AN IMAGE FORMING APPARATUS

(75) Inventors: Jarrett Clark Gayne, Lexington, KY (US); Royden Thomas Kern, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 331 days.

(21) Appl. No.: 12/424,905

(22) Filed: Apr. 16, 2009

(65) Prior Publication Data

US 2010/0266314 A1 Oct. 21, 2010

(51) Int. Cl.
*G03G 15/08* (2006.01)

(52) U.S. Cl. ..... 399/258; 399/260; 399/262; 399/263

(58) Field of Classification Search ..... 399/27, 399/258, 259, 260, 262, 263
See application file for complete search history.

(56) References Cited

U.S. PATENT DOCUMENTS

| | | | | |
|---|---|---|---|---|
| 4,076,149 | A | 2/1978 | Saxinger | |
| 4,362,444 | A | 12/1982 | Watkins | |
| 4,650,097 | A | 3/1987 | Hagihara et al. | |
| 5,139,176 | A | 8/1992 | Reindl et al. | |
| 5,652,947 | A * | 7/1997 | Izumizaki | 399/58 |
| 5,797,061 | A | 8/1998 | Overall et al. | |
| 5,802,420 | A | 9/1998 | Garr et al. | |
| 6,108,502 | A | 8/2000 | Kawada et al. | |
| 6,510,291 | B2 | 1/2003 | Campbell et al. | |
| 6,600,882 | B1 | 7/2003 | Applegate et al. | |
| 6,718,147 | B1 | 4/2004 | Carter et al. | |
| 6,735,403 | B2 | 5/2004 | Kanno et al. | |
| 6,856,779 | B2 | 2/2005 | Ota et al. | |
| 7,088,943 | B2 | 8/2006 | Iikura et al. | |
| 7,187,876 | B2 | 3/2007 | Ito et al. | |
| 7,389,072 | B2 | 6/2008 | Hebner et al. | |
| 7,433,632 | B2 | 10/2008 | Askren et al. | |
| 2002/0090230 | A1 * | 7/2002 | Hatori et al. | 399/227 |
| 2007/0183815 | A1 | 8/2007 | Himes | |
| 2008/0219709 | A1 | 9/2008 | Hebner et al. | |
| 2008/0292331 | A1 * | 11/2008 | Yokomori et al. | 399/27 |
| 2010/0247158 | A1 * | 9/2010 | Nishiwaki | 399/258 |

OTHER PUBLICATIONS

Non-final Office Action dated Jun. 10, 2011 for related co-pending U.S. Appl. No. 12/424,921.

* cited by examiner

*Primary Examiner* — David Porta
*Assistant Examiner* — Faye Boosalis
(74) *Attorney, Agent, or Firm* — John Victor Pezdek

(57) ABSTRACT

The present invention provides a toner container system, such as a toner cartridge, comprising a housing including a first reservoir for containing toner and a second reservoir for receiving toner from the first reservoir and transferring the toner to an image forming apparatus, and a toner transfer mechanism that includes a rotatable roller member having in the surface thereof a recess defined by a concave surface having a radius of curvature, and wherein the roller member is rotatable from a first position at which the recess is open to the first reservoir and a second position at which the recess is open to the second reservoir, for conveying toner from the first reservoir to the second reservoir upon rotation of the roller member from the first position to the second position, and a rotatable wiper member disposed within the second reservoir and being sized and having a flexible distal end rotatable through the recess in contact with the concave surface when the roller member is in the second position.

20 Claims, 3 Drawing Sheets

ROTATING TONER CLEANING MEMBER FOR A TONER DELIVERY DEVICE IN AN IMAGE FORMING APPARATUS

CROSS REFERENCE TO RELATED APPLICATIONS

Cross-reference is made to copending U.S. patent application Ser. No. 12/424,921, filed Apr. 16, 2009 entitled "Geneva Drive And Locking Mechanism Therefor In A Toner Metering Mechanism For An Image Forming Apparatus" and assigned to the assignee of the present invention.

BACKGROUND OF THE INVENTION

1. Field of the Invention

The present invention relates to toner container structures for image forming devices, and more particularly to a toner container structure having a rotating toner transfer mechanism that includes a rotating member for cleaning toner from the surfaces of the toner transfer mechanism.

2. Description of the Related Art

Image forming devices including copiers, laser printers, facsimile machines, and the like, include a photoconductive drum having a rigid cylindrical surface that is coated along a defined length of its outer surface. The surface of the drum is charged to a uniform electrical potential and is selectively exposed to light in a pattern corresponding to an original image. The areas of the drum surface exposed to light are discharged and form a latent electrostatic image on the drum surface. Developer material, such as toner having an electrical charge, is attracted to the drum surface and is used for forming the toned image.

The toner is typically contained in structure such as a cartridge adjacent to the photoconductive drum for supplying the image forming material to a developer roller and to the photoconductive drum for forming a toned image. The toner is typically transferred to the developer roller from a working reservoir within the cartridge. A toner transfer mechanism transfers amounts of toner from a storage reservoir to the working reservoir when the system calls for toner. A recording sheet, such as a blank sheet of paper, is charged and brought into contact with the discharged photoconductive drum surface and the toned image thereon forming the toner image is electrostatically transferred to the recording sheet in the form of a toned electrostatic image. The recording sheet is then heated to permanently fuse the toner to the sheet.

Additional background information on the structure and operation of image forming devices and toner container structures and toner supply mechanisms disposed within image forming devices generally may be found by reference to U.S. Pat. No. 6,510,291 to Campbell et al., and to U.S. Patent Publication No. US 2008/0219709, by Hebner et al.

In the event that the toner contained in the cartridge has poor flow properties, the toner transfer mechanism alone may not properly, sufficiently and consistently transfer toner from the toner storage reservoir to the working reservoir. The toner may build up on the surfaces of the toner transfer mechanism with the result that the amount of toner transferred by the transfer mechanism is not consistent from one transfer event to another also referred to a toner metering cycles. Estimating toner consumption and cartridge life can therefore be problematic and toner transfer may become insufficient to sustain acceptable print quality.

There is, therefore, a need for a toner container structure having structure or mechanism for cleaning toner from the surfaces of the toner transfer mechanism to ensure that the amounts of toner transferred in the transfer events or toner metering cycles are substantially consistent.

SUMMARY OF THE INVENTION

The present invention provides a toner container system (such as a toner cartridge) wherein a rotating toner removal member is provided to clean toner from the surfaces of the toner transfer mechanism.

The invention therefore relates to a toner container system for an image forming apparatus comprising, a first reservoir for containing toner;

a second reservoir for receiving toner from said first reservoir;

a toner transfer mechanism disposed between said first reservoir and said second reservoir for transferring toner from said first reservoir to said second reservoir;

said toner transfer mechanism including a rotatable roller member having a recess in the surface thereof, said recess defined by a concave surface having a radius of curvature, said roller member being rotatable from a first position wherein said recess is open to said first reservoir and a second position wherein said recess is open to said second reservoir, for conveying toner from said first reservoir to said second reservoir upon rotation of said roller member from said first position to said second position; and a rotatable wiper member disposed within said second reservoir for removing toner from said recess, said wiper member being sized and having a distal end rotatable through said radius of curvature of said recess and operatively disposed to rotate through said recess in contact with said surface when said roller member is in said second position, whereby substantially all toner is removed from said recess.

The invention further relates to a system for transferring image forming material from a first reservoir to a second reservoir within an image forming apparatus, comprising, a rotatable transfer mechanism including a generally cylindrically shaped rotatable roller member having at least one recess in the surface thereof;

wherein each said recess is defined by a concave surface having a radius of curvature, said roller member being rotatable from a first position wherein said recess is open to said first reservoir and a second position wherein said recess is open to said second reservoir, for conveying toner from said first reservoir to said second reservoir upon rotation of said roller member from said first position to said second position; and a rotatable wiper member disposed within said second reservoir for removing image forming material from said recess, said wiper member being sized and having a distal end rotatable through said radius of curvature of said concave surface and operatively disposed to rotate through said recess in substantial contact with said concave surface when said roller member is in said second position, whereby substantially all image forming material is removed from said recess.

The invention further relates to a toner cartridge for an image forming apparatus comprising, a housing including first reservoir for containing toner, and a second reservoir for receiving toner from said first reservoir and transferring the toner to an image forming apparatus;

a rotatable toner transfer mechanism including a generally cylindrically shaped rotatable roller member having at least one recess in the surface thereof, for conveying toner from said first reservoir to said second reservoir;

wherein each said recess is defined by a concave surface having a radius of curvature, said roller member being rotatable from a first position wherein said recess is open to said first reservoir and a second position wherein said recess is open to said second reservoir, for conveying toner from said first reservoir to said second reservoir upon rotation of said roller member from said first position to said second position; and a rotatable wiper member disposed within said second reservoir for removing toner from said recess, said wiper member being sized and having a distal end rotatable through said radius of curvature of said concave surface and operatively disposed to rotate through said recess in substantial contact with said concave surface when said roller member is in said second position, whereby substantially all toner is removed from said recess.

Advantageous aspects of the invention reside in the prevention of toner buildup on the surfaces of the toner transfer mechanism. The amount of toner transferred by the toner transfer mechanism in each transfer event is therefore substantially consistent. The invention utilizes existing rotating members in the sump of a cartridge structure to support a member for cleaning the rotor surfaces of the toner transfer mechanism on each rotation of the rotor which results in more consistent delivery of toner, without substantial modification to the toner transfer mechanism within the cartridge structure.

These and other attributes, aspects and advantages of the invention will become apparent as a detailed description of representative embodiments proceeds.

BRIEF DESCRIPTION OF THE DRAWINGS

Figure 1:
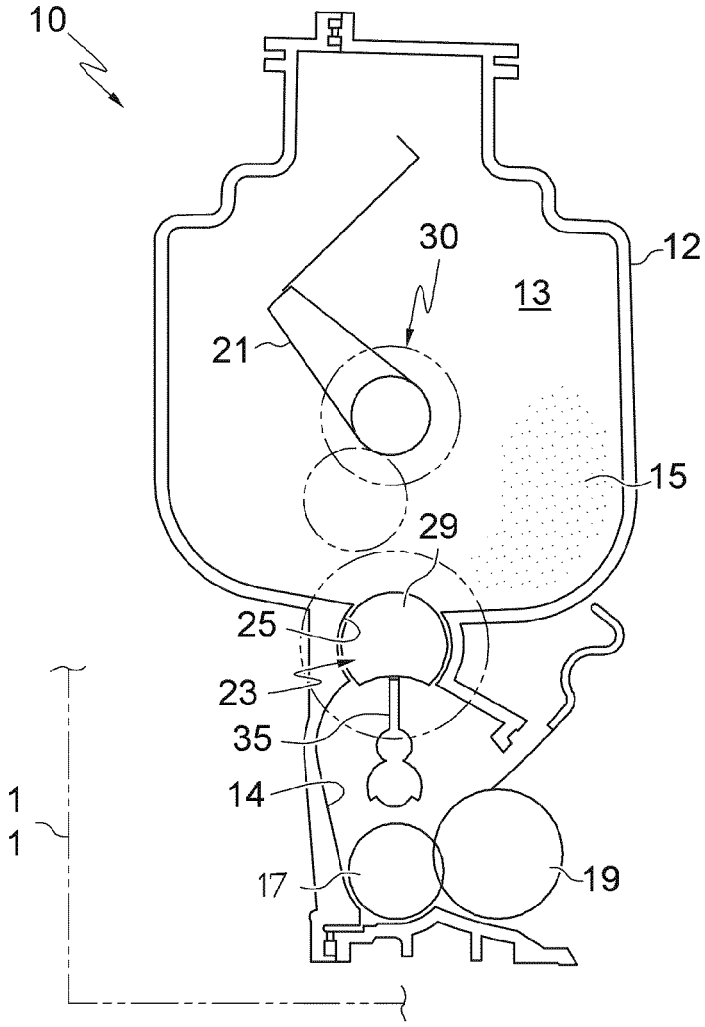
Figure 2:
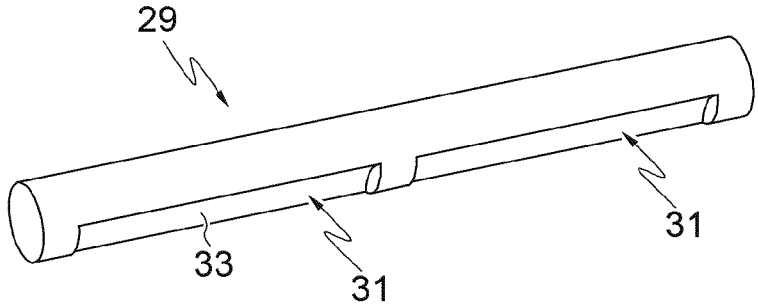
Figure 3:
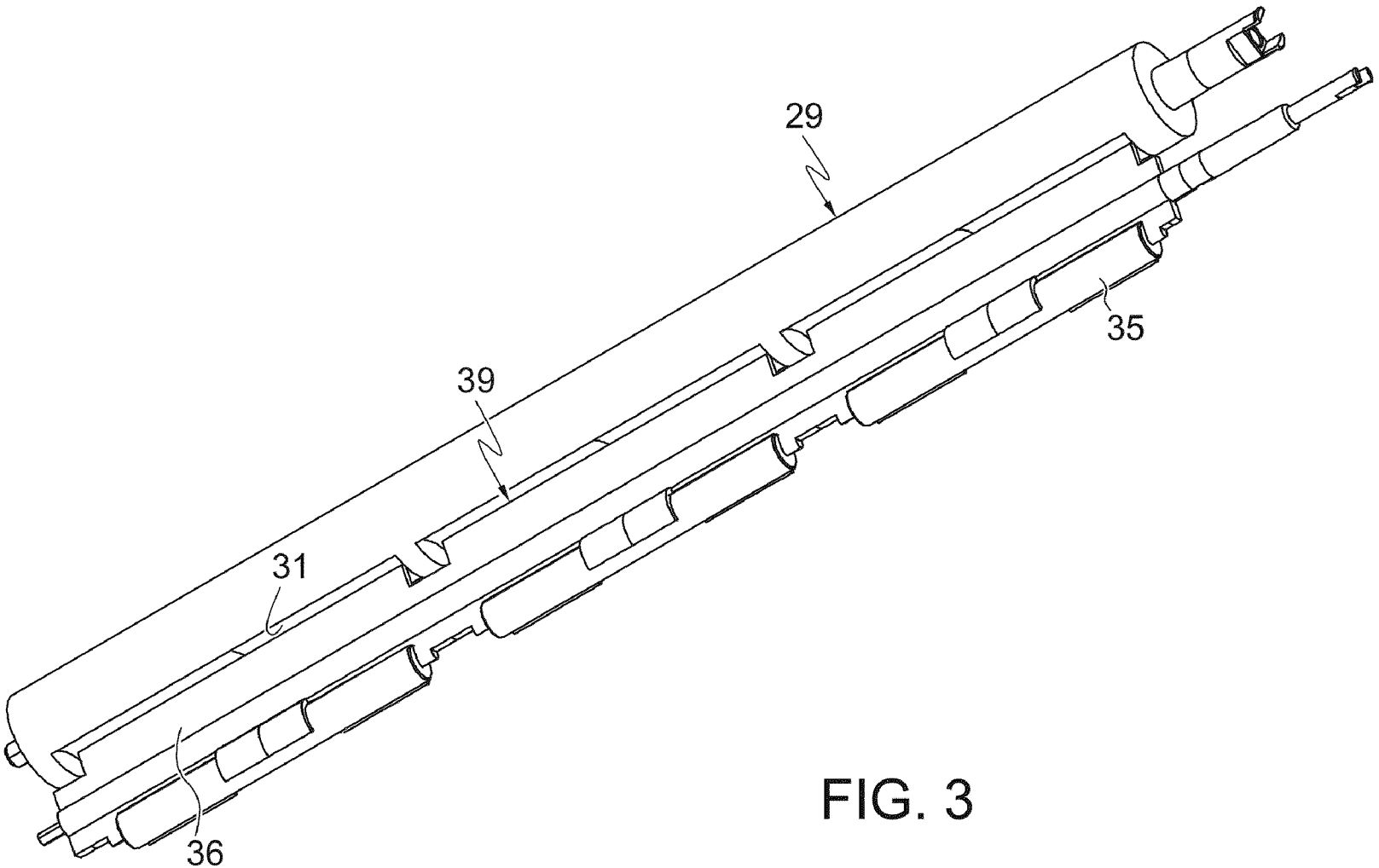
Figure 5:
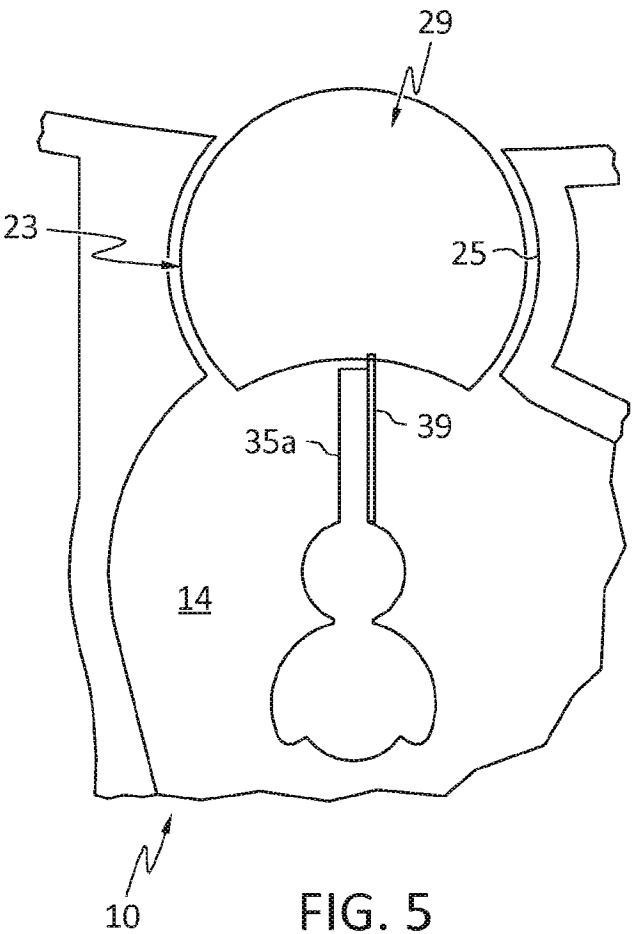
Figure 4:
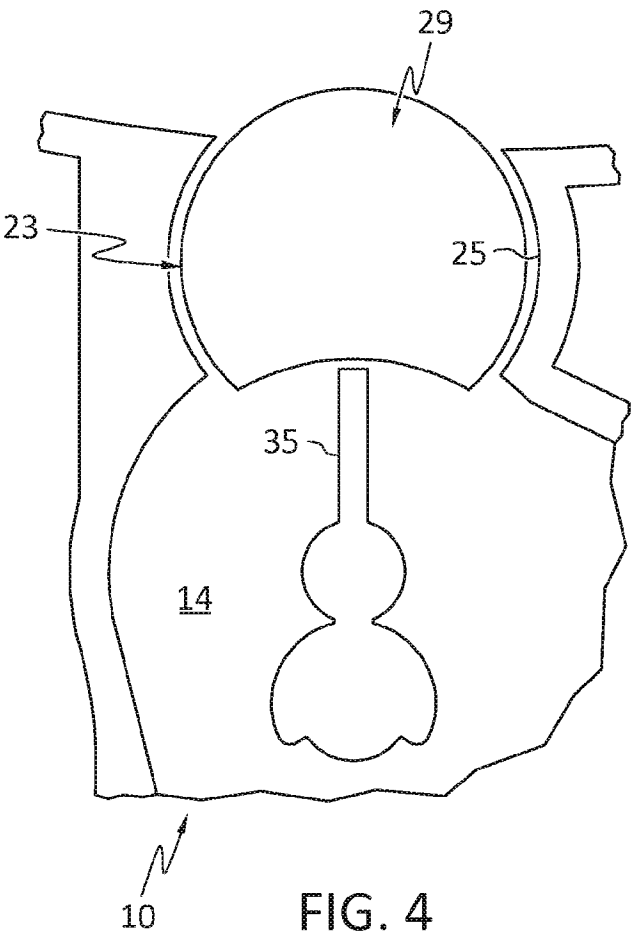

Having thus described the invention in general terms, reference will now be made to the accompanying drawing figures that are not necessarily drawn to scale, and wherein:

FIG. 1 shows a sectional view of a toner container system according to the invention as disposed within and forming a part of an image forming apparatus;

FIG. 2 is a perspective view of a toner metering roller member including one or more concave recessed regions in the roller surface;

FIG. 3 is a perspective view of the toner metering roller of FIG. 2 engaged with a toner wiper structured according to the invention;

FIG. 4 is an enlarged sectional view of the toner transfer mechanism of the FIG. 1 structure including an existing structure for a rotating toner wiper member; and FIG. 5 is an enlarged sectional view of the toner transfer mechanism of the FIG. 1 structure wherein the rotating toner wiper member is modified according to the teachings of the invention.

DETAILED DESCRIPTION

The present invention will now be described more fully hereinafter with reference to the accompanying drawing figures, in which some, but not all embodiments of the invention are shown. The invention may be embodied in many different forms and should not be construed as limited to the embodiments set forth herein; rather, these embodiments are provided so that this disclosure will satisfy applicable legal requirements.

Reference is now made to the Campbell et al. '291 patent for a description of the basic elements and operation of the overall electrophotographic image forming process in a typical image forming apparatus utilizing a plurality of color cartridges. Specific reference is made to FIG. 1 of Campbell et al. '291 and the accompanying text briefly describing the structure and operation of a four cartridge color laser printer as a non-limiting exemplar of image forming devices generally using toner for printing with a photoconductor.

Reference is also made to Patent Publication No. US 2008/0219709 by Hebner et al. relating to a toner cartridge structure including a mechanism for conveying a quantity of image forming material (toner) between selected regions of the cartridge. The mechanism of Hebner et al. includes a toner metering roller having one or more convex recesses in the roller surface for transferring toner from an upper region to a lower region of the cartridge. A rotating wiper in the lower region of the cartridge aids in the removal of toner from the roller surfaces and would replace the mechanism described in Hebner et al.

Referring now to FIG. 1, shown therein is a sectional view of an exemplary toner container 10 system, such as a toner cartridge, according to the invention, as disposed within and forming a part of an image forming apparatus 11. In one aspect of the invention, toner container 10 comprises housing 12 defining therewithin two reservoirs, namely first upper reservoir 13 and second lower reservoir 14 for supplying image forming material, such as toner 15, to toner adder roller 17, which in turn supplies toner to an image developer roller mechanism 19 which then supplies toner to a photoconductive drum (not shown) within image forming apparatus 11. Upper reservoir 13 may include paddles or agitators, represented in FIG. 1 by paddle 21, for assisting in agitating toner 15 in reservoir 13 and transferring toner to lower reservoir 14 as described more fully below.

In one representative aspect of the invention, container 10 may be structured to contain black toner for a black only image forming apparatus (such as a printer). More typically, however, container 10 may comprise one of a plurality of similarly structured toner containers, such as the various toner cartridges included in a color image forming apparatus, all of which cartridges are generally of similar construction but distinguished by the toner color contained therein. A typical color image forming apparatus may include individual cartridges including respective toner colors of black, magenta, cyan, and yellow, each respective color forming an individual image of a single color that is combined in layered fashion with the other colors to create the final multi-colored image. Toner container 10 (and each of the other toner containers included in the image forming apparatus structured according to the invention) may include an image developer roller mechanism 19 that operatively contacts the photoconductive drum within an image forming apparatus 11 indicated by the dashed line.

A toner transfer metering roller mechanism 23 is disposed within an intermediate region 25 between upper reservoir 13 and lower reservoir 14. Roller mechanism 23 is configured to supply toner 15 from reservoir 13 to reservoir 14 when the system calls for toner, as through a toner level sensing device 35 disposed within reservoir 14. The sensing device may be of any conventional type known in the applicable art as would be selected by one skilled in the art for inclusion in the overall container 10 structure. Roller mechanism 23 includes a toner metering roller 29 shown separately in the perspective view (not to scale) in FIG. 2. Toner metering roller 29 is structured so as to facilitate the transfer of measured amounts of toner 15 from upper reservoir 13 to lower reservoir 14.

In one embodiment of the invention, movement of toner 15 from reservoir 13 to reservoir 14 may be facilitated using a geared toner supply mechanism having any suitable structure as would occur to the skilled artisan practicing the invention such as represented in dashed lines as toner transfer mechanism 30, along with attached paddle 21 within reservoir 13 for agitating and moving toner 15 into toner transfer mechanism 23, such as described in the Campbell et al. '291 patent or in the Hebner et al. publication. Toner transfer mechanism 23 includes a toner metering roller 29 such as shown in the representative structure depicted in perspective in FIG. 2. Paddle 21 may be sized to extend substantially the length of toner container 10 and to rotate closely to the walls of reservoir 13 so as to agitate and prevent clumping of toner 15, in manner more fully described in the Campbell et al. '291 patent. Paddle 21 may otherwise be configured for the intended purpose as would occur to the skilled artisan practicing the invention.

With reference now specifically to FIG. 2, it is seen that in one exemplary embodiment of the invention, toner metering roller 29 may be a generally cylindrical in shape and include one or more axially spaced concave recesses 31 defined in the cylindrical surface of roller 29 by concave surfaces 33 having a radius of curvature. In one aspect of the invention, recesses 31 have the substantially trough-like shape of an axial cylindrical section. Recesses 31 are shown in FIG. 2 as being aligned axially along the surface of roller 29, but it is understood that, within the teachings of the invention and the scope of the appended claims, other axial and circumferential placements of recesses 31, as would occur to the skilled artisan practicing the invention, are contemplated herein about the entire 360 degree circumferential surface of and along the length of roller 29.

It is noted that roller 29 is shown in FIG. 2 as being generally cylindrical in shape with a substantially circular cross section. It is understood, however, that roller 29 could, within the scope of these teachings, have a cross section of other shape (i.e., oval, square, etc.) as would occur to the skilled artisan practicing the invention, such cross sections representing alternative embodiments of the invention.

Recesses 31 of roller 29 are of known volumetric size so as to facilitate the transfer of measured amounts of toner 15 from reservoir 13 to reservoir 14 with each rotation of roller 29. Accordingly, upon rotation of roller 29, each recess 31 is positioned alternately at a first position open to reservoir 13 where it is filled with toner 15 and at a second position (such as is shown in the figures) open to reservoir 14 where the toner is removed from recess 31 as by rotation of a member 35 as described more fully below. Toner consumption from cartridge 10 may be monitored and approximated by counting the rotations of roller 29 using associated hardware or software (not shown). However, if the toner 15 varies in its bulk flow characteristics, it may collect within and on the surfaces of the recesses 31 in roller 29, so that insufficient toner may be transferred to the developer roller, with resultant poor print quality, and toner consumption from cartridge is uncertain. It may be noted that toner bulk flow characteristics may depend upon variables such as toner average particle size or shape, particle size distribution, toner composition, environmental considerations, and the design and operation of the cartridge and toner transfer mechanism.

In the Hebner et al. publication the importance of active toner removal from the recesses is emphasized. In the embodiments described by Hebner et al., recesses 31 were described as each being in the general shape of a pocket defining a convex cylindrical shaped surface 33. In this embodiment, the recesses 31 can be described as being in the general shape of a pocket defining a concave cylindrical shaped surface 33. The radius of roller 29 may be about 8.4 mm and the radius of recess 31 may be about 11 mm, providing a ratio of about 1.3. It is suggested that the radius of curvature of the concave surface 33 may be about 0.75 to 3.0 times the radius of curvature of roller 29. Selection of the curvature of roller 29 relative to the curvature of convex surface 33 may be made by one skilled in the applicable art practicing the invention, the specific selection not considered limiting of the invention or of the appended claims. Roller 29 may typically comprise a material such as high impact polystyrene, polycarbonate, acetol, metals or similar materials as would occur to the skilled artisan guided by these teachings. Judicious selection of roller 29 structure and material composition and recess 31 configuration may facilitate relatively smooth engagement with a wiper upon rotation of roller 29 as discussed more fully below.

Referring now to FIG. 3, shown therein is a perspective view of the metering roller 29 of FIG. 2 engaged with a rotating member 35 structured according to the invention. In FIG. 3, member 35 may extend substantially along the length of roller 29 and include one or more enlarged portions defining flanges 36 that are positioned to confront each recess 31 in engagement with roller 29. With reference additionally to FIG. 1, it is seen that member 35 may be disposed at any convenient location within the container 10 assembly so that upon rotation of roller 29, each flange 36 on member 35 engages a portion of the corresponding recess 31 to promote the removal of toner from recesses 31 of roller 29.

It can be seen that the rotating member can be implemented in the fashion substantially described in the Hebner et al. publication, including the structure of member 35 and toner metering roller 29. Member 35 may be formed from any one or more of the materials as suggested in the Hebner et al. publication, such as a metal (including stainless steel) in thickness of from about 0.001 to about 0.003 inch, or a polymeric material, such as a thermoplastic or thermoset type material, such as extrusions of the thermoplastic polyester, such as biaxially-oriented polyethylene terephthalate (boPET) sold under the tradename MYLAR, in thicknesses from about 0.003 to about 0.020 inch, or other thermoplastics including polyesters, polycarbonates, polysulphones, polyvinyl chloride, or thermoplastic elastomers, including polyurethane or polyester type elastomers. It is understood, however, that the specific selected sizes, structure and composition of member 35 is not intended to be limited to those exemplary embodiments specifically described in illustration of the invention herein.

Referring now to FIG. 4, shown therein is one embodiment of the invention. In this embodiment, the toner sensing system includes a rotating member 35 that can be positioned to function as described. It is seen that member 35 may comprise materials that in physical contact with the surfaces 33 of recesses 31 may substantially damage surfaces 33 or other portions of toner meter roller 29. Further, if member 35 does not contact the surfaces 33 of recesses 31, such as suggested in FIG. 4 by a gap between the distal end of member 35 and the concave surface 33 of roller 29, toner may build up on the surfaces 33 and consequently effectively reduce the volume of toner delivered and create variation to the volume of toner delivered from recesses 31 in each rotation of toner meter roller 29. A highly inaccurate estimation of the amount of toner 15 delivered to reservoir 14 from toner transfer mechanism 23 would result in a correspondingly inaccurate estimation of cartridge 10 life. In accordance therefore with a feature of the invention, and with reference to FIG. 3 in conjunction with FIG. 5, wiper members 39 are attached to the flange 36 portions of member 35*a*. Members 39 are sized in length to span the length of each recess 31 and in width to contact surfaces 33 of recesses 31 for facilitating complete removal of toner from surfaces 33 of recesses 31. Further, members 39 may be sized to define an interference contact with surfaces 33 to ensure complete 100 percent removal of toner from surfaces 33. Members 39 may therefore comprise thin sheets of pliable materials such as urethane, polyurethane, high density polyurethane, paper based products, boPET or similar materials as would occur to the skilled artisan guided by these teachings. Attachment of members 39 to flanges 36 of member 35*a* may be accomplished using adhesives, such as rubber based adhesives, acrylic based adhesives or the like, or mechanically as by screws, rivets or the like, or otherwise as by such as heat fusion to the surfaces of flanges 36, the specific attachment means being selectable by one practicing the invention and not considered limiting of these teachings or of the appended claims.

The rotation of rotating member 35 and toner metering roller 29 are sequenced using a Geneva gearing system described in the co-pending application cross-referenced above so that rotating member 35 will intermittently rotate into the recesses 33 when toner metering roller is in the second position for delivering toner to the lower toner reservoir 13. Without proper sequencing of the respective rotational movements of rotating member 35 and toner metering roller 29, these parts may become jammed together.

It is noted further that each toner container in an image forming apparatus having multiple toner containers (cartridges) each containing a respective toner color may be structured substantially as described above for container 10.

Another aspect of the invention may be embodied in an image forming apparatus 11 wherein toner transfer mechanism 23 and lower reservoir 14 are structured as elements of the image forming apparatus 11 itself. In this arrangement, reservoir 13 containing the original charge of toner 15 may be insertable into apparatus 11 as a separate unit and operatively engage toner transfer mechanism 23 in substantially similar manner to that depicted in the accompanying drawing figures.

The invention therefore provides a toner container structure having a rotating toner transfer mechanism that includes a rotating member for removing toner from the surfaces of the toner transfer mechanism. It is understood that the invention may be practiced in ways other than as specifically set forth herein without departing from the scope and essential characteristics of the invention. The description of several embodiments of the invention as herein presented is therefore intended for purposes of illustration. It is not intended to be exhaustive or to limit the invention to the precise forms disclosed, and obviously many modifications and variations are possible in light of the above teachings. It is intended that the scope of the invention be defined by the claims appended hereto.

What is claimed is:

1. A toner container system for an image forming apparatus comprising:

a first reservoir for containing toner;

a second reservoir for receiving toner from said first reservoir;

a toner transfer mechanism disposed between said first reservoir and said second reservoir for transferring toner from said first reservoir to said second reservoir;

said toner transfer mechanism including a roller member rotatably mounted within an opening in said toner transfer mechanism and having a curved surface and a recess in said curved surface, said recess formed by a concave surface having a radius of curvature and a length extending axially along a portion of said roller member surface and having a volume defined by the radius of curvature of the concave surface of the recess, the length of the recess and a radius of curvature of the roller member, said roller member being rotatable between a first position and a second position wherein when in said first position said recess is closed to said second reservoir and open to said first reservoir for receiving a known volume of toner from said first reservoir and when in said second position said recess is closed to said first reservoir and open to said second reservoir for delivering said known volume of toner into said second reservoir for each rotation of said roller member; and a rotatable wiper member disposed within said second reservoir for removing said known volume of toner from said recess, said rotatable wiper member having a length corresponding to said length of said recess and having a distal end rotatable through said radius of curvature of said recess and operatively disposed to rotate through said recess in contact with said concave surface thereof when said roller member is in said second position, whereby substantially all of said known volume of toner is removed from said recess.

2. The toner container system of claim 1 wherein said rotatable wiper member includes a flexible portion at said distal end thereof having an interference contact with said concave surface of said recess when said roller member is in said second position.

3. The toner container system of claim 2 wherein said flexible portion of said rotatable wiper member comprises a material selected from a group consisting of urethane, polyurethane, high density polyurethane, boPET, and paper based products.

4. The toner container system of claim 1 wherein said roller member is substantially cylindrical in shape with the radius of curvature thereof being from about 5 to 15 mm.

5. The toner container system of claim 4 wherein said radius of curvature of said concave surface forming said recess is in a range of from about 0.75 to about 3 times said radius of curvature of said roller member.

6. The toner container system of claim 1 wherein said roller member comprises a material selected from a group consisting of high impact polystyrene, polycarbonate, acetol and metals.

7. The toner container system of claim 1 wherein said second reservoir operatively connects to said image forming apparatus for supplying toner thereto.

8. A system for transferring image forming material from a first reservoir to a second reservoir within an image forming apparatus, comprising:

a rotatable transfer mechanism including a roller member having a curved surface and at least one recess in said curved surface thereof and mounted within an opening in said transfer mechanism;

wherein each of said at least one recess is defined by a concave surface having a radius of curvature and a length extending axially along a portion of said roller member surface, said at least one recess forming a defined volume within said roller member, said roller member being rotatable from a first position wherein each of said at least one recess is open to said first reservoir and closed to said second reservoir, and a second position wherein each of said at least one recess is closed to said first reservoir and open to said second reservoir, said rotatable transfer mechanism conveying the defined volume of image forming material in each of said at least one recess from said first reservoir to said second reservoir upon each rotation of said roller member from said first position to said second position; and at least one rotatable wiper member disposed within said second reservoir for removing image forming material from each of said at least one recess, said each of at least one rotatable wiper member having a length corresponding to said length of said recess and having a distal end rotatable through said radius of curvature of said concave surface and operatively disposed to rotate through each said at least one recess in substantial contact with said concave surface when said roller member is in said second position, whereby substantially all image forming material is removed from each of said at least one recess.

9. The system of claim 8 wherein said at least one rotatable wiper member includes a flexible portion at said distal end thereof having an interference contact with said concave surface of each of said at least one recess when said roller member is in said second position.

10. The system of claim 9 wherein said flexible portion of said at least one rotatable wiper member comprises a material selected from a group consisting of urethane, polyurethane, high density polyurethane, boPET, and paper based products.

11. The system of claim 8 wherein said roller member is substantially cylindrical in shape and has a radius of curvature of from about 5 to 15 mm.

12. The system of claim 11 wherein said radius of curvature of said concave surface defining each of said at least one recess is in a range of from about 0.75 to about 3 times said radius of curvature of said roller member.

13. The system of claim 8 wherein each of said at least one roller member comprises a material selected from a group consisting of high impact polystyrene, polycarbonate, acetol and metals.

14. The system of claim 8 wherein said second reservoir operatively connects to said image forming apparatus for supplying image forming material thereto.

15. A toner cartridge for an image forming apparatus, comprising:

a housing including first reservoir for containing toner, and a second reservoir for receiving toner from said first reservoir and transferring said toner to an image forming apparatus;

a rotatable toner transfer mechanism including a cylindrically shaped rotatable roller member having at least one recess in said surface thereof, the roller member mounted within a cylindrical opening in said toner transfer mechanism;

wherein each of said at least one recess is defined by a concave surface having a radius of curvature and a length extending axially along a portion of said roller member cylindrical surface, said roller member being rotatable from a first position wherein each of said at least one recess is open to said first reservoir and closed to said second reservoir, and a second position wherein each of said at least one recess is closed to said first reservoir and open to said second reservoir, said rotatable toner transfer mechanism conveying a known amount of toner in each of said at least one recess from said first reservoir to said second reservoir upon each rotation of said roller member from said first position to said second position; and at least one rotatable wiper member disposed within said second reservoir for removing toner from each of said at least one recess, said each of least one rotatable wiper member having a length corresponding to said length of each said at least one recess and having a distal end rotatable through said radius of curvature of said concave surface and operatively disposed to rotate through each said at least one recess in substantial contact with said concave surface when said roller member is in said second position, whereby substantially all toner is removed from each of said at least one recess.

16. The toner cartridge of claim 15 wherein said at least one rotatable wiper member includes a flexible portion at said distal end thereof having an interference contact with said concave surface of each of said at least one recess when said roller member is in said second position.

17. The toner cartridge of claim 16 wherein said flexible portion of said at least one rotatable wiper member comprises a material selected from a group consisting of urethane, polyurethane, high density polyurethane, boPET, and paper based products.

18. The toner cartridge of claim 15 wherein said roller member has a radius of curvature of from about 5 to 15 mm.

19. The toner cartridge of claim 18 wherein said radius of curvature of said concave surface defining each of said at least one recess is in a range of from about 0.75 to about 3 times said radius of curvature of said roller member.

20. The toner cartridge of claim 15 wherein said roller member comprises a material selected from a group consisting of high impact polystyrene, polycarbonate, acetol and metals.

* * * * *